US006729252B2

(12) United States Patent
Wada et al.

(10) Patent No.: US 6,729,252 B2
(45) Date of Patent: May 4, 2004

(54) THREAD DEVICE FOR SEWING MACHINE

(75) Inventors: Fumio Wada, Chofu (JP); Hiroyuki Kotaki, Chofu (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 10/269,624

(22) Filed: Oct. 11, 2002

(65) Prior Publication Data

US 2003/0070598 A1 Apr. 17, 2003

(30) Foreign Application Priority Data

Oct. 12, 2001 (JP) ..... 2001-315692

(51) Int. Cl.[7] ..... D05B 47/04
(52) U.S. Cl. ..... 112/278; 112/279; 112/302
(58) Field of Search ..... 112/278, 302, 112/270, 279, 220, 254, 225

(56) References Cited

U.S. PATENT DOCUMENTS 5,010,834 A 4/1991 Iimuro et al.
5,603,462 A * 2/1997 Conrad et al. ..... 112/302 X
5,682,830 A * 11/1997 Katou et al. ..... 112/225
5,881,660 A 3/1999 Hiramatsu et al.

* cited by examiner

*Primary Examiner*—Peter Nerbun
(74) *Attorney, Agent, or Firm*—Merchant & Gould, P.C.

(57) ABSTRACT

A thread winder unit, which is capable of winding thread of spools set on spool bars, is removably attached to a machine body. The sewing machine includes a feed motor for feeding the thread during sewing, an upper thread state detecting sensor disposed between the feed motor and the thread winder unit for detecting tensed thread, and a CPU for controlling thread winding operations based on a signal from the upper thread state detecting sensor. The sewing machine intermittently drives the feed motor in a reverse direction to that in the sewing to feed the thread toward the thread winder unit, every time the upper thread state detecting sensor detects the tensed thread, and the thread winder unit winds the fed thread around the spool. The CPU, recognizing the thread wound by a given amount, stops winding.

6 Claims, 10 Drawing Sheets

THREAD DEVICE FOR SEWING MACHINE

BACKGROUND OF THE INVENTION

1. Field of the Invention

The invention relates to a thread device for a sewing machine including a thread spool wound with thread to be fed to a stitching section of a sewing machine.

2. Description of the Related Art

Conventionally, an automatic thread feeding device for a home-use sewing machine feeds a necessary amount of thread for forming one stitch in sewing operation. This kind of automatic thread feeding device is disclosed, for example, in U.S. Pat. No. 5,010,834.

On the other hand, in sewing operations, such as forming embroidery patterns, and stitching together fabrics having different colors or patterns, it is required to exchange thread during the sewing.

When exchanging thread in a conventional home-use sewing machine, thread spools have been generally exchanged by hand. In an industrial embroidery sewing machine, various color-thread spools are set in advance and the spools are automatically exchanged in sequence to form multi-color patterns.

However, the exchange of thread spools by hand as in the home-use sewing machine makes the operation troublesome and reduces work efficiency as the number of colors increases. On the other hand, for example, U.S. Pat. No. 5,881,660 discloses the automatic exchange of thread for the industrial sewing machine. This kind of automatic exchange is superior in work efficiency, but it needs a complicated exchanging device in much higher cost, which makes it difficult to apply the device to a relatively low price home-use sewing machine.

SUMMARY OF THE INVENTION

It is therefore an object of the invention to provide a sewing machine that is able to exchange thread efficiently with relatively simple structure in lower cost.

In order to solve the problems mentioned above, the invention provides a thread device for a sewing machine as exemplified in FIGS. 11 and 12 as a first aspect of the invention.

The thread device includes:

- a spool mounting member (spool bars 31 and 32) which rotatably supports a thread spool wound with thread to be fed to a needle of the sewing machine and is attached to a machine body of the sewing machine;
- a thread winding mechanism (thread winder unit 30) which is connected to the thread spool and feeds the thread backward, being fed from the thread spool to a needle side, to the thread spool;
- a feed mechanism (feed roller 11 and feed motor 12) which is disposed on a thread path between the thread winding mechanism and the needle of the sewing machine and performs an operation feeding the thread of the thread spool to the needle side and an operation feeding the thread in the needle side to a side of the thread winding mechanism;
- a thread detecting mechanism (upper thread state detecting sensor 20) which is disposed between the feed mechanism and the thread winding mechanism and generates a first detecting signal when detecting the thread in a tense state;

- a feed-backward amount detecting mechanism (wound-amount measuring counter) which generates a second detecting signal when an amount of the thread fed backward to the thread spool by the thread winding mechanism reaches a given value; and
- a controller (CPU 81*a*) which feeds a given amount of the thread to the side of the thread winding mechanism by operating the feed mechanism when the first detecting signal is generated by the thread detecting mechanism, repeats a feed-backward operation in which the given amount of the thread is fed backward by the thread winding mechanism after feeding the given amount of the thread, and stops winding when the second detecting signal is generated by the feed-backward amount detecting mechanism.

According to the first aspect of the invention, the thread is automatically wound under the control of the controller, so that the winding process is made easier, resulting in improved efficiency of exchanging spools. In addition, the feed means is used for winding the thread as well as supplying the thread in a sewing process, utilizing a conventionally mounted structure, and therefore the winding mechanism is realized in relatively lower cost.

For the winding method by the winding mechanism, each spool is rotated via the spool mounting member, or instead the thread may be wound around a fixed spool. The winding mechanism may be fixedly installed on the machine, or may be prepared as an independent device.

Further, the method of detecting the winding of a given amount of thread is properly selectable. For instance, the winding operation can be stopped as the completion of the winding after a certain time has elapsed without detecting the tense state of thread by the detecting means, because, when the tense state of thread is not detected by the detecting means while the winding mechanism continues to wind the thread, this means that the thread end has passed out the feed means.

As another way, the length of thread fed out from the spool is known, for example, as the length from the spool mounting member to a sewing needle through a predetermined route. Therefore, storing a winding amount of thread in a memory based on this length, and counting the wound amount of thread, the winding can be stopped when the counted value reaches the stored value.

In a second aspect of the invention, the controller obtains a reference wound amount from an amount wound by the thread winding mechanism and uses the reference wound amount as a reference value for a wound amount in a following process.

According to the second aspect of the invention, when a thread length to be wound is given, a multiplying number of the reference wound amount for completing the winding can be obtained. That is, quantitative control can be easily performed as in obtaining the driven number of the feed means.

In a third aspect of the invention, the thread winding mechanism includes:

- a motor which rotates the thread spool in a feed-backward direction; and
- a transmitting mechanism which transmits drive of the motor to the thread spool.

According to the third aspect of the invention, when the thread winding device is attached to the machine, the device automatically winds the thread, to thereby effectively wind the thread and make the exchange of spool easier.

In a fourth aspect of the invention, the motor is attached to the machine body of the sewing machine, and the transmitting mechanism is attached to the spool mounting member and includes:

a coupling member which is couplable and uncouplable with respect to a drive shaft of the motor; and a coupling mechanism which couples the coupling member to the thread spool.

Accordingly, the spool mounting member is attachable to the machine body of the sewing machine and the spool mounting member can be miniaturized and made lighter.

In a fifth aspect of the invention, a thread device for a sewing machine, includes:

spool mounting members each of which rotatably supports a thread spool wound with thread different from the other thread to be fed to a needle of the sewing machine and is attached to a machine body of the sewing machine;

a motor which rotates the thread spool in a feed-backward direction; and a transmitting mechanism which transmits drive of the motor to the thread spool; and a switching mechanism (switching arm holding member 60) which selectively couples one of the thread spools to the transmitting mechanism.

According to the fifth aspect of the invention, a plurality of thread spools are provided and thread of one of the thread spools can be selectively wound by the switching mechanism. Accordingly, during sewing with the use of thread from one spool, another spool can be mounted on the other spool mounting members, so that, after finishing the sewing, the thread from the latter spool can be used for sewing upon winding up the thread of the former spool by the winding device. This operation is especially useful in such a case that the thread needs to be frequently exchanged as in embroidery sewing.

The switching means can employ an electrical driving source such as a motor or a solenoid, or a mechanically linked switching mechanism to be manually operated.

In a sixth aspect of the invention, the thread device according to the fifth aspect is characterized in that, the switching mechanism includes:

a switching drive source which electrically operates and is attached to the machine body of the sewing machine; and a lever which is attached to the spool mounting member and couples the transmitting mechanism to one of the thread spools by an operation of the switching drive source.

According to the sixth aspect of the invention, the device can be miniaturized and made lighter because the drive source for winding operation is equipped inside the machine body.

BRIEF DESCRIPTION OF THE DRAWINGS

FIG. 7(*b*) illustrates a state that the bail is turned to horizontal direction.

FIG. 10(*a*) being a part of a working screen when the winder unit is installed, FIG. 10(*b*) being a selection screen, and FIG. 10(*c*) being an editing screen.

DETAILED DESCRIPTION OF THE PREFERRED EMBODIMENTS

A detailed description will now be given of one embodiment of the invention with reference to the accompanying drawings.

Figure 1:
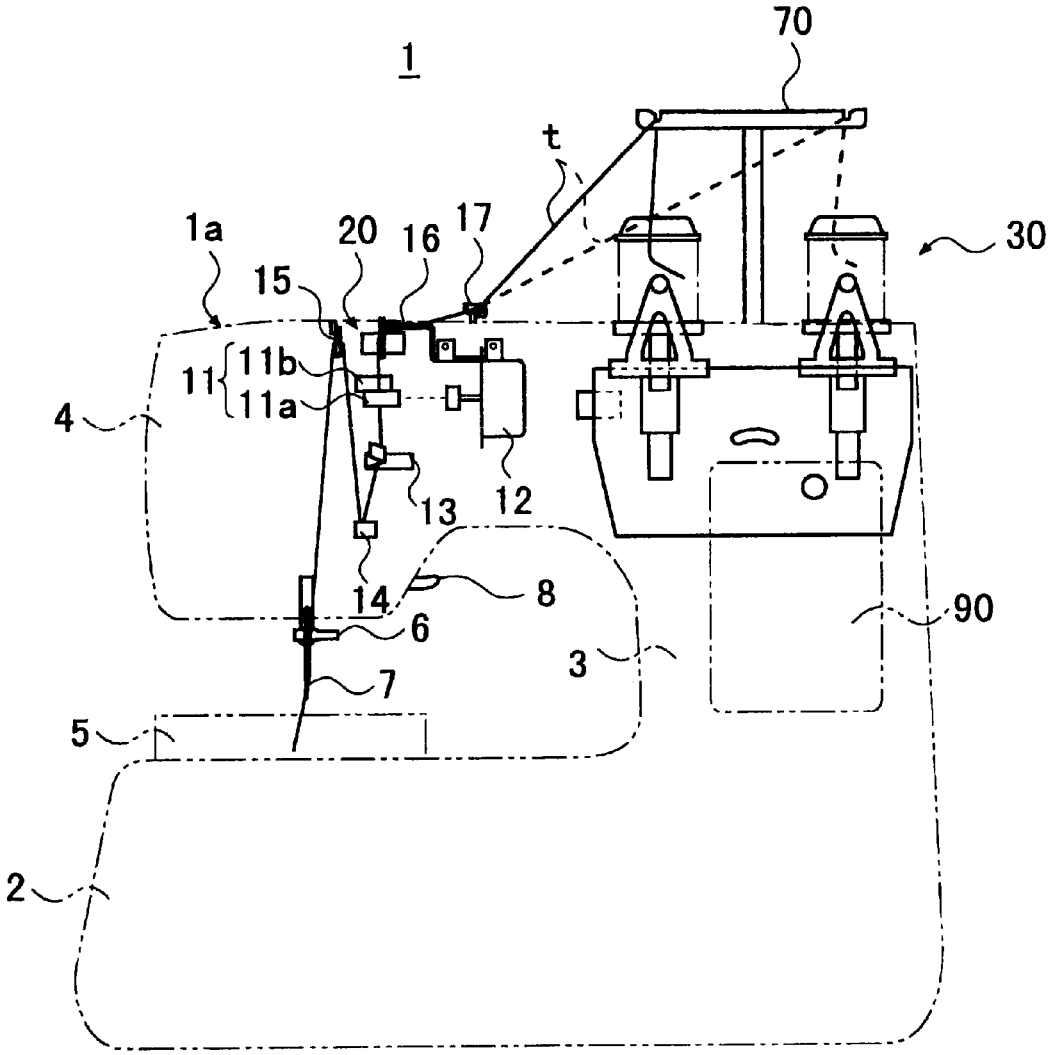
FIG. 1 is a schematic diagram showing a sewing machine according to one embodiment of the invention.

FIG. 1 shows a sewing machine 1 according to one embodiment of the invention. The machine 1 is a home-use sewing machine with an embroidery mode, and an embroidery device 5 and a thread winder unit 30 removably attached to a machine body 1*a*. The machine body 1*a* consists of a machine bed 2, a vertical body 3 standing on the bed 2, and an arm horizontally extending from the vertical body 3.

The machine 1, under the control of a controller 81 (FIG. 9) that will be explained later, goes to a standard mode in which lock stitches and embroidery stitches of a given pattern are formed when the embroidery device 5 is removed from, and when the device 5 is attached to, the attachment is detected by an embroidery device detecting sensor 5*a* (FIG. 9) to switch the machine 1 to an embroidery mode.

Figure 2A:
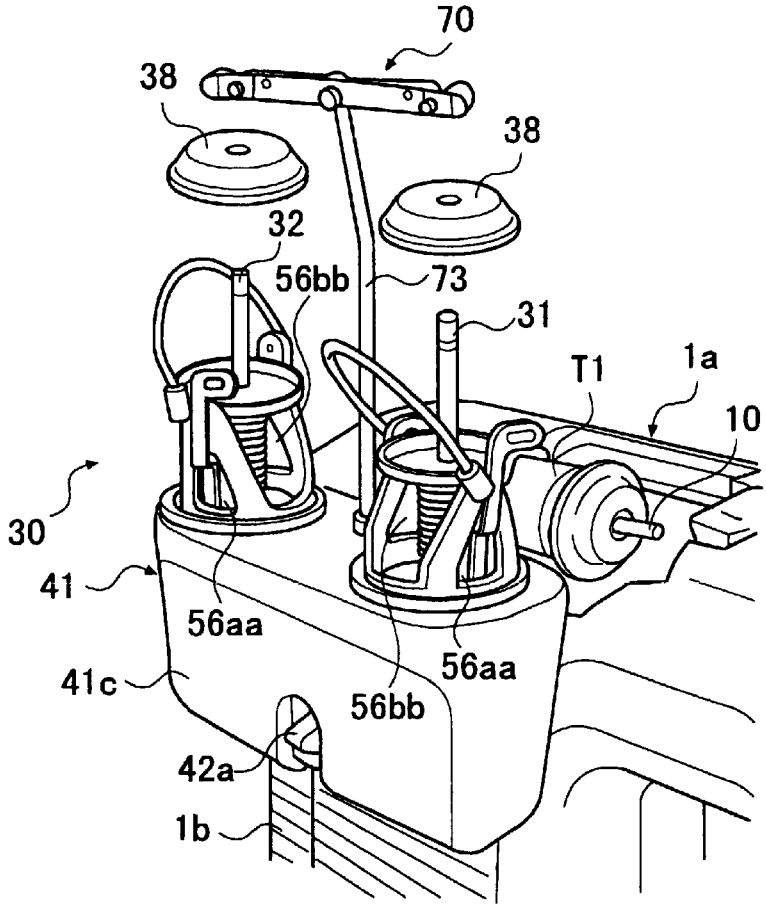
FIG. 2(*a*) is a perspective view showing a thread winder unit attached to the sewing machine, and FIG. 2(*b*) is a perspective view showing a mounting surface of the winder unit for attaching to the machine, and a structure of a machine body side.
Figure 2B:
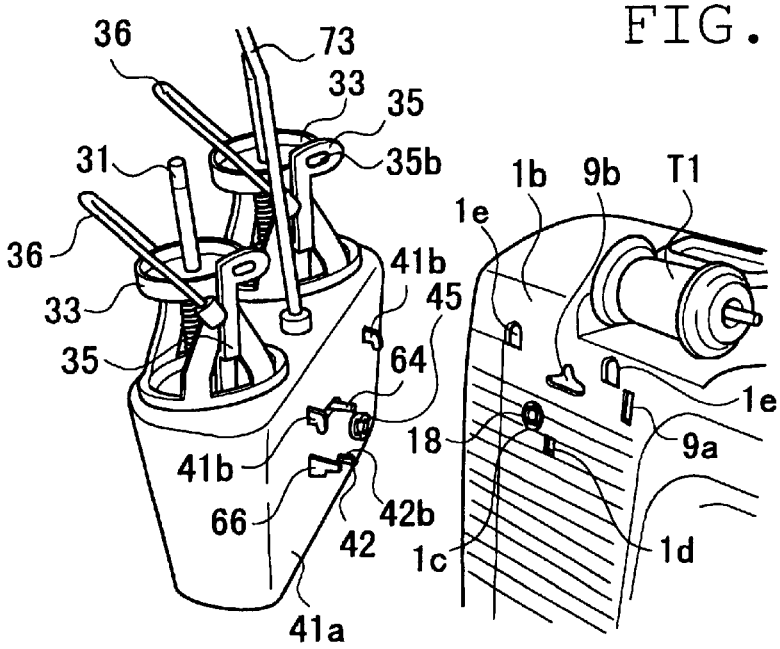

Referring to FIGS. 1 and 2, the machine body 1*a* is provided with a spool pin 10 into which a spool can be fit at the rear part of the upper surface, and there can be attached to a rear panel 1*b* the thread winder unit 30 having spool bars 31 and 32 into which respective spools are to be fit. Upper thread is supplied from the spool pin10 or spools mounted on the winder unit 30. Meanwhile, the machine 1 has an automatic threading mechanism that is capable of automatically threading the upper thread through a sewing needle 7, and therefore the upper thread from the winder 30 or the spool pin 10 automatically passes through the needle 7 at a predetermined timing when the thread is hooked at given positions on the arm 4. Since the spool pin 10 is not a subject matter of the invention, the upper thread from the winder unit 30 only will be explained hereinafter.

At the center portion of the upper surface of the arm 4, a thread guide 17 is fixed. At the vicinity of the guide 17 and inside the arm 4, there is fixed a base tension part 16 for giving a constant tension to the upper thread t. This base tension part 16 closes to give tension to the thread at the time of sewing, automatic thread cutting, and automatic threading, and opens when the thread is wound by the winder unit 30.

Figure 3:
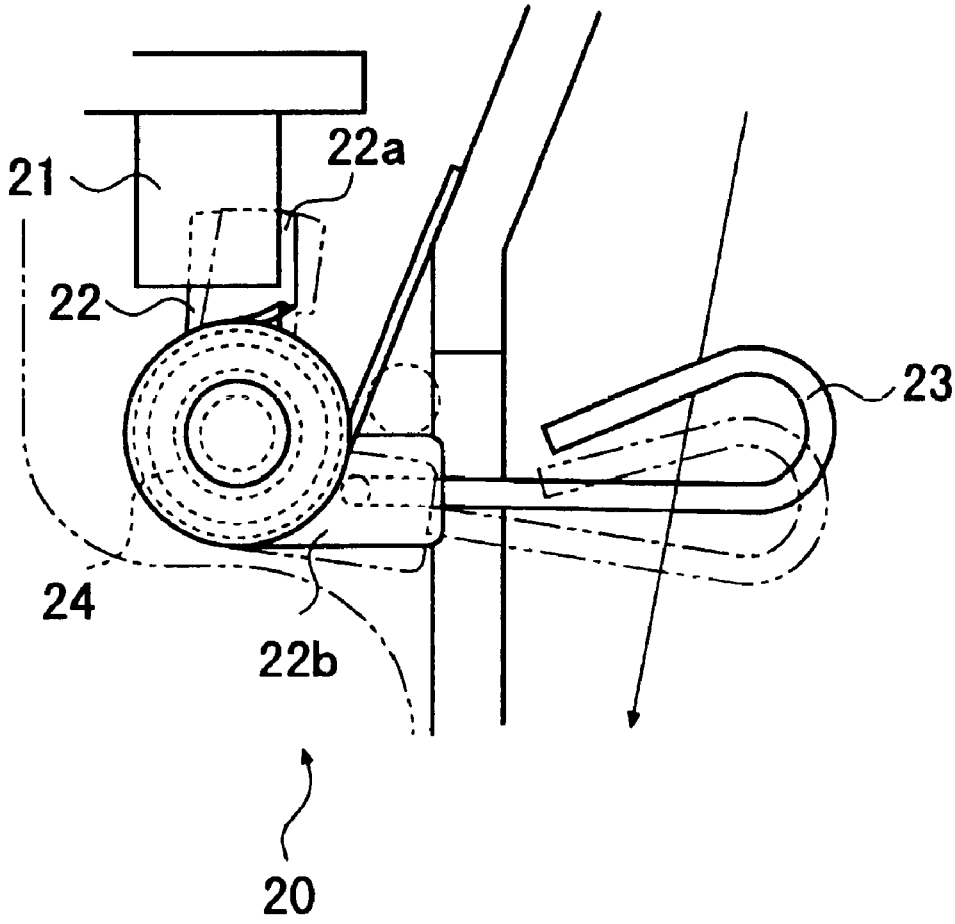
FIG. 3 is a plan view showing the detail of an upper thread state detecting sensor.

There is also provided an upper thread state detecting sensor 20 at the vicinity of the base tension part 16. The detecting sensor 20 detects the tense state of the thread at a winding process, acting as a thread detecting means of the invention. FIG. 3 shows the detail of the sensor 20. The sensor 20 includes a photo-interrupter 21, an intercepting plate 22, a plate actuating member 23, and a helical torsion spring 24.

The photo-interrupter 21 is formed U-shaped in section, having a light-emitting element and a light-receiving element (not shown) facing each other, and one end side 22*a* of the plate 22 formed in L-shape is located so as to be in and out between the elements. The actuating member 23, formed in U-shape at the top, is fixed at the other end 22*b* of the plate 22, and is passed through with the thread extending from the base tension part 16 as indicated by an arrow.

The torsion spring 24 is mounted with its center at the bent portion of the plate 22, hooking one end to the machine frame and the other end to the plate 22. With this structure, when the thread is loosened, or does not pass through it, one end 22*a* of the plate 22 is positioned between the light elements (solid lines in FIG. 3) with force of the spring 24 to output an OFF signal from the photo-interrupter to CPU 81*a*. When the thread passing through the actuating member 23 is tensed, the thread pushes down the actuating member 23 against the urging force of the spring 24 to rotate the plate 22 clockwise (phantom lines in FIG. 3) so that the photo-interrupter outputs an ON signal.

There is provided a feed roller 11 inside the arm 4 for feeding the upper thread supplied from the winder unit 30 toward a sewing needle 7. The feed roller 11 consists of a driving roller 11*a* rotatably driven by a feed motor 12 of a stepping motor, and a driven roller 11*b* rotated following the rotation of the roller 11*a* when being in contact with it. The driven roller 11*b* gets in contact with the driving roller 11*a* when a presser lifter 8 (see FIG. 1) is operated so as to lower a presser foot 6, and apart from the roller 11*a* when the lifter 8 is operated in a reverse direction.

The feed motor 12 is driven during sewing intermittently, not continuously, and allows the feed roller 11 to intermittently feed the thread by a certain amount. The feed motor 12 is driven during the thread winding process in a reverse direction to that in the sewing process, so that the feed roller 11 feeds the thread intermittently to the spool side. In other words, such operation is repeated in the thread winding process that every feed of a certain amount of thread by the feed roller 11 in the reverse direction causes the thread to be loosened, and winding the thread by a wind motor 82, explained later, causes the thread to be tensed. With this operation, the thread detecting sensor 20 generates ON signals (thread in tense state) and OFF signals (thread in loosened state) alternately.

The feed roller 11 and the feed motor 12 constitute a feed means in the invention.

A rotation transmitting mechanism from the motor 12 to the roller 11 and an interlocking mechanism between the presser lifter 8 and the driven roller 11*b* have been well known, and therefore a detailed explanation will be omitted.

The upper thread t supplied from the winder unit 30 passes through the thread guide 17, through the base tension 16 and the detecting sensor 20, and is pitched and held by the feed roller 11.

There is provided an upper thread guide 13 inside the arm 4 and below the feed roller 11 for guiding the thread to a given direction. The thread t fed from the roller 11 passes through the guide 13, through a thread take-up spring 14 and through a thread take-up 15 provided outside a cover of the arm 4.

The arm 4 includes a needle bar (not shown), to which the sewing needle 7 is fixed at the lower end. The thread t is guided to the needle 7 through the take-up 15.

The presser foot 6 is provided neighboring the needle 7, and is movable up and down with the operation of the presser lifter 8 as in a conventional machine.

Referring to FIG. 2, the thread winder unit 30, which is a thread winding mechanism and a thread winding device in the invention, is removably attached to the rear panel 1*b* of the machine body 1*a*. The unit 30 has two spool bars (spool mounting members) 31 and 32 capable of mounting respective spools thereon; each part supplies the thread from it and winds the thread from the needle 7 after sewing. The spool set on the bar 31 is sometimes hereinafter referred to as a spool A, and that on the bar 32 a spool B.

Figure 4:
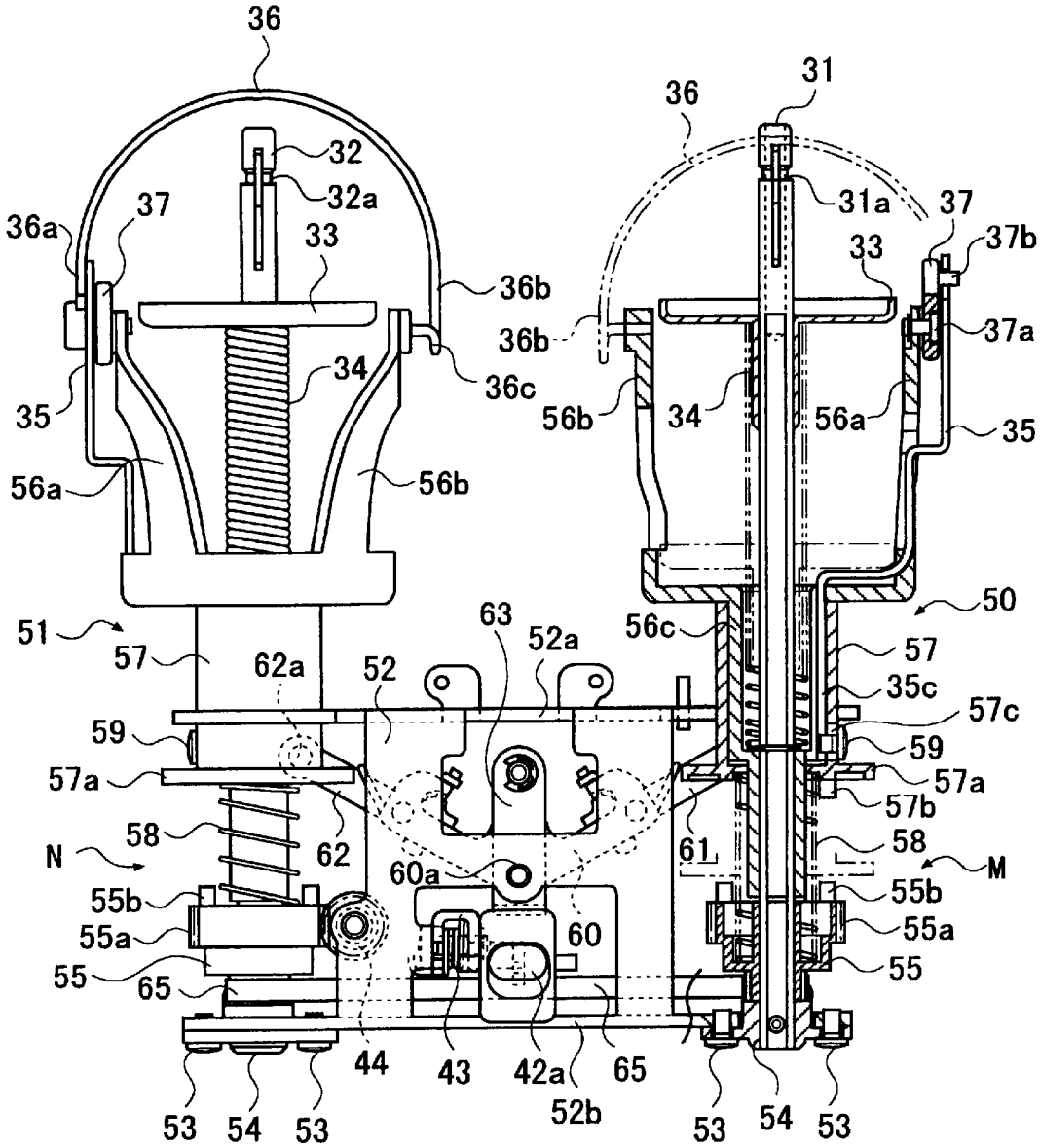
FIG. 4 is a side view showing a first winder part and a second winder part of the thread winder unit, partially in cross section.

The unit 30 has a supporting box 41 for supporting the spool bars 31 and 32. An inserting protrusion 42 with a recess 42*b* and auxiliary protrusions 41*b* and 41*b* each top of which is bent down, project out from a mounting surface 41*a* of the box 41. On a box surface 41*c*, there is provided an operation lever 42*a* substantially unified with the protrusion 42. The lever 42*a* and the protrusion 42 are rotatable about a shaft (not shown) at their middle portion, and are urged upward at the end of the protrusion 42 by a lever spring 43 as shown in FIG. 4.

The winder unit 30 is attached to the machine body 1*a* by the following procedure. The protrusion 42 is inserted into an insertion hole 1*d* formed on the rear panel 1*b* with downward rotation against the urging force of the spring 43. Then, with upward rotation of the protrusion 42 urged by the spring 43, the recess 42*b* gets engaged with the machine frame around the insertion hole 1*d*. At the same time, the auxiliary protrusions 41*b* and 41*b* are engaged with auxiliary holes 1*e* and 1*e* formed right and left above the insertion hole 1*d*.

When removing the unit 30, the operation lever 42*a* is moved upward to cause the protrusion 42 to be lowered with the box 41 lifted up.

The machine body 1*a* has a unit detecting sensor 87 (FIG. 9), and a sensor hole 9*a* on the rear panel 1*b*. The mounting surface 41*a* of the box is provided with a sensor protrusion 66 that can be engaged with the sensor hole 9*a*. When the unit 30 is attached to the rear panel 1*b*, the sensor protrusion 66 is inserted into the sensor hole 9*a* to output a unit detecting signal from the detecting sensor 87 to the controller 81.

Figure 5:
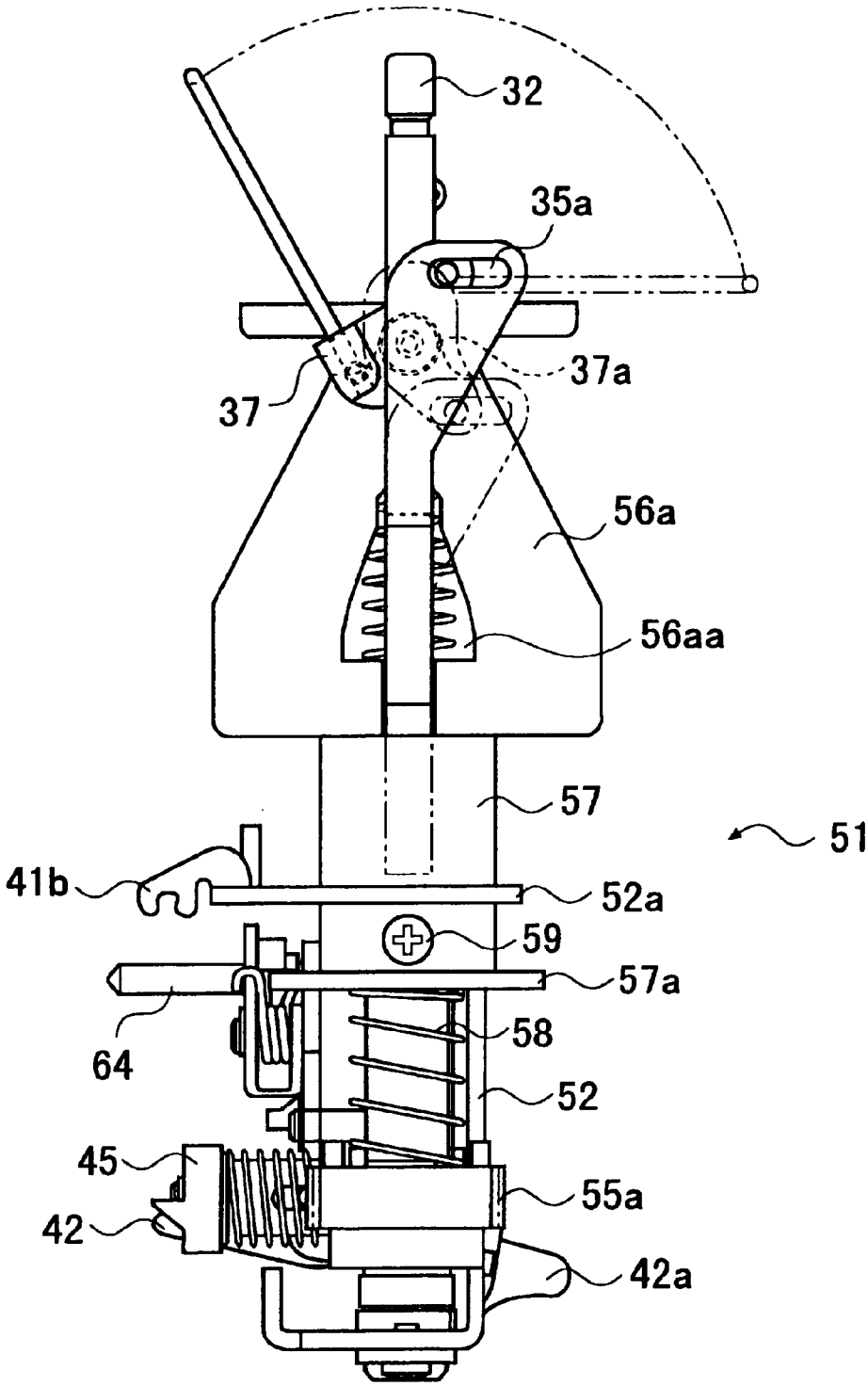
FIG. 5 is a side view showing the second winder part.

Referring to FIGS. 4 and 5, inside the box 41, there are provided a first winder part 50 and a second winder part 51, which support the spool bars 31 and 32, respectively, and perform thread winding operation. The fist and second winder parts 50 and 51 have almost the same structures, and therefore like elements are designated by like numerals and symbols. In FIG. 4, the first winder part 50 is depicted in section for convenience. The first and the second winder parts 50 and 51 are fixed in the supporting box 41, and supported on a mounting plate 52 having an upper base plate 52*a* and a lower base plate 52*b*.

At the lower end of the first part 50 (the second part 51), there is provided a bearing 54, which is secured to the lower base plate 52*b* with screws 53 and 53. The hollowed slender spool bar 31 (32) is fixed to and supported on the bearing 54.

On the bearing 54, there is provided a winding gear member 55 having a gear 55*a* on its periphery, and the spool bar 31 passes through the center of the bearing 54. Formed on the upper surface of the gear member 55 is a lower connecting part 55*b* with a plurality of teeth protruding upward. There is formed a ring-shape space inside the gear member 55, and a first compression spring 58 is mounted into the space.

Over the gear member 55, a cylindrical inner rotating body 56*c* is provided surrounding the spool bar 31 (32). The rotating body 56*c* has a larger inside diameter at the middle position forming a space between the spool bar 31 (32), and a second compression spring 34 is mounted into the space. The lower end of the spring 34 is supported on the rotating body 56*c*.

At the upper part of the spool bar 31 (32), a spool saucer 33, slidable up and down, is provided for receiving the lower end of the spool, the lower end of the saucer 33 being in contact with the upper end of the second compression spring 34. With this, the spring 34 urges upward the saucer 33.

At the top end of the spool bar 31 (32), an engage groove 31*a* (32*a*) is formed in a circler direction for attaching a cap 38 as shown in FIG. 2. When setting the spool A on the spool bar 31, the spool A is inserted into the bar 31 through its vertical hole at the center, pushed down with the saucer 33 against the urging force of the spring 34, and fit the cap 38 from the upper side. So is for the spool B.

When the spool is set as described above, the spool is always urged upward by the spring 34, and is in contact with the cap 38 at the upper end.

The upper end portion of the rotating body 56*c* has a further larger inside diameter, and, as shown in FIGS. 2 and 4, is continued to two spool walls 56*a* and 56*b* facing each other, which project out above the box 41, surrounding the spool. The spool walls 56*a* and 56*b* are formed in triangular shape, and have inside triangular openings 56*aa* and 56*bb*, respectively.

cylindrical outer rotating body 57 is fit to the outside of the inner rotating body 56*c*. The outer rotating body 57 is supported on the upper base plate 52*a*. Meanwhile, the auxiliary protrusion 41*b* is provided on the upper base plate 52*a* as shown in FIG. 5.

At the lower part of the outer rotating body 57, a flange 57*a* is formed in the circular direction. Formed on the lower surface of the flange 57*a* is an upper connecting part 57*b* with a plurality of teeth corresponding to the lower connecting part 55*b*. The lower connecting part 55*b* and the upper connecting part 57*b* constitute a positive clutch.

The upper end of the first compression spring 58 is pressed into the inside of the upper connecting part 57*b*.

A switching pin 62*a* on a first switching arm 61 and a second switching arm 62, which will be explained later, is in contact with the upper surface of the flange 57*a*. Each of the arms 61 and 62 drives the flange 57*a* downward against the force of the spring 58, so that the upper connecting part 57*b* is engaged with the lower connecting part 55*b*. The clutch at the side of the first winder part 50 is denoted as the clutch M, and that at the second part 51 the clutch N, for convenience. FIG. 4 shows the switching pin 62*a* on the second arm 62 only, but the same in the pin on the first switching arm 61.

A screw hole 57*c* is formed on a part of the outer rotating body 57, and a groove (not shown) extending vertically is formed on the inner rotating body 56*c* at the position corresponding to the hole 57*c*. A bail actuating part 35 is inserted into the groove at its foot portion 35*c* and fixed with a bail fixing screw 59. The downward drive of the flange 57*a* by the first switching arm 61 (second arm 62) causes to lower the outer rotating body 57 together with the bail actuating part 35, the inner rotating body 56*c*, and the spool walls 56*a* and 56*b*.

The screw 59 is positioned on the groove of the inner rotating body 56*c* through the outer body 57, so that the rotation of the outer body 57 causes to rotate together the inner body 56*c*, the spool walls 56*a* and 56*b*, the bail actuating part 35 and the bail 36.

As shown in FIGS. 2 and 4, the bail actuating part 35 looks out on the opening 56*aa* of the spool wall 56*a*, and further bends outward, extending beyond the top end of the spool wall 56*a*. At the top end of the actuating part 35, there is formed a horizontal slot 35*b* elongated horizontally.

The bail 36 formed in a semi-circle is provided over the spool walls 56*a* and 56*b* for guiding the thread when winding the thread.

Figure 7A:
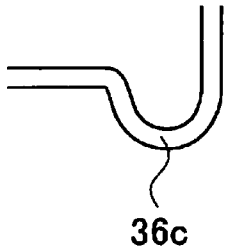
FIG. 7(*a*) shows a curved portion of a bail.
Figure 7B:
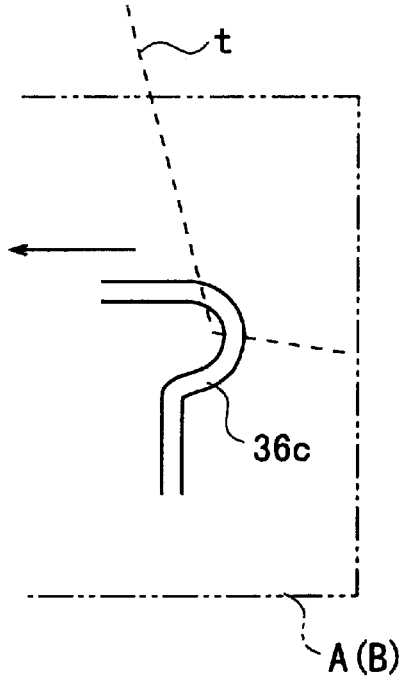

One end portion 36*b* of the bail 36 is rotatably attached to the upper rim portion of the spool wall 56*b*. The end portion 36*b* has, as shown in FIG. 7(*a*), a curved portion 36*c* bending downward in U-shape at its upright state (FIG. 4).

At the vicinity of the other end 36*a* of the bail 36, a bail mounting member 37 for attaching the end 36*a* is rotatably attached with a screw 37*a* to the upper rim portion of the spool wall 56*a*. The end 36*a* is attached to a position apart from the screw 37*a* by a certain distance.

Provided above the mounting member 37 is a protruding pin 37*b* protruding outward, which engages with the slot 35*b* of the actuating member 35. With this structure, when the actuating member 35 moves up and down, the mounting member 37 rotates around the screw 37*a*, being guided by the protruding pin 37*b*, and at the same time the bail 36 rotates around the screw 37*a* to turn down sideway as shown by virtual lines in FIG. 5. When the bail 36 changes its direction as described above, the curved portion 36*c* at the other end 36*b* is directed sideway as shown in FIG. 7(*b*).

When the bail 36 turns sideway, the curved portion 36*c* catches the thread t extending toward a thread hooking body 70, and is positioned about the center of the spool A (B) in a height direction. The curved portion 36*c* rotates toward an arrow direction indicated in FIG. 7(*b*) when the thread is wound. Thus, the curved portion 36*c* winds the thread on the spool A (B) consistently, regulating an angle between the thread t and the spool A (B).

Figure 8:
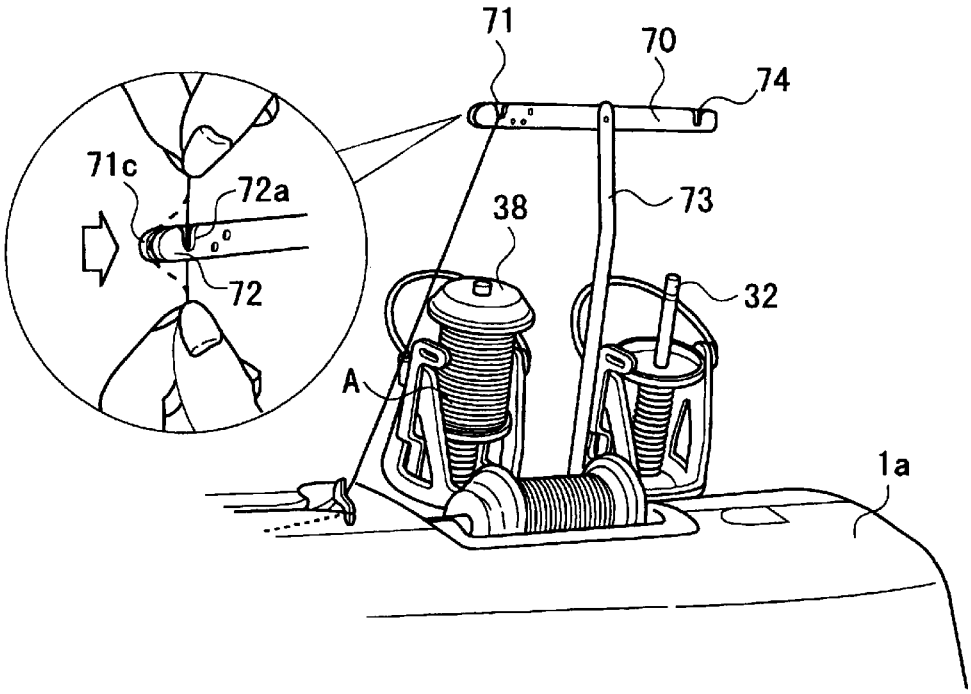
FIG. 8 is a perspective view showing the thread winder unit viewed from the front side.

Over the supporting box 41, as shown in FIGS. 2 and 8, there is provided a horizontally elongated thread hooking body 70 supported by a supporting bar 73 for hooking the thread from the spools mounted on the respective spool pins 31 and 32. The hooking body 70 includes a first hooking portion 71 for hooking the thread from the spool A, and a second hooking portion 74 for hooking the thread from the spool B. The first hooking portion 71, as shown in an elongated view in FIG. 8, includes a main part 71*c*, and a leaf spring 72 having a recess 72*a* and fixed to the main part 71*c*. The operator manually inserts the thread from the spool A to be nipped between the part 71*c* and the spring 72, hooks the thread on the recess 72*a* and guides it toward the needle 7. The second hooking portion 74 has the same structure as the first portion 71.

Referring back to FIG. 4, at the center of the mounting plate 52, there is mounted the switching arm holding member (switching means) 60 rotatable about a pin 60*a*, and having the first switching arm 61 and the second switching arm 62 at right and left sides, respectively. The holding member 60 has an extending part 63 formed extending upward from the center portion, and a switch actuating pin 64 is fixed to the extending part 63, projecting out from the box 41 (FIGS. 2 and 5).

The actuating pin 64, when the winder unit 30 is attached to the machine body 1*a*, is inserted into a switch opening 9*b* formed in a near triangular shape on the rear panel 1*b*. Inside the opening 9*b*, there is provided a swinging member (not shown) to be swung right and left by a switching motor (switching drive source) 83 (FIG. 9) of a stepping motor. The top end of the actuating pin 64 is fixed to the swinging member. The swing motion of the swinging member causes the pin 64 to swing right and left about a predetermined origin point, which causes the holding member 60 to rotate about the pin 60*a*.

As a swinging mechanism for the swinging member, a combination of a sun gear and a planet gear may be employed. The swinging mechanism has a switching origin detecting sensor 89 for detecting the origin point.

When the actuating pin 64 moves to the right in FIG. 4 with the rotation of the switching motor 83, the switching pin 62*a* at the top of the arm 61 pushes down the flange 57*a* in the first winder part 50 for the clutch M to be engaged.

As for the second winder part 51, reverse rotation of the motor 83 moves the pin 64 to the left, which causes the pin 62*a* on the arm 62 to push down the flange 57*a* for the clutch N to be engaged.

A winding motor (winding drive source) 82 (FIG. 9) of a stepping motor is equipped inside the rear panel 1*b* of the machine body 1*a*. An intermediate gear 18 for transmitting the rotation of the motor shaft is provided inside a gear hole 1*c* formed on the rear panel 1*b*.

Figure 6:
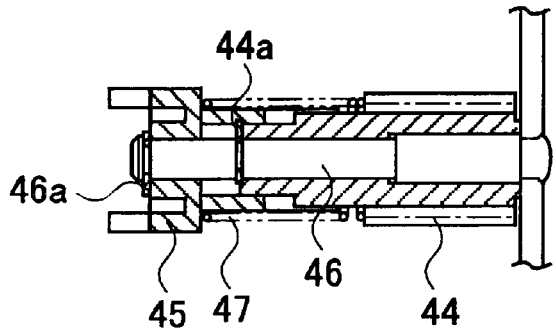
FIG. 6 is a vertical sectional view showing a winding transmission part and a winding worm gear.

This device is provided a transmitting mechanism described as follows. From a lower portion of the mounting surface 41*a* of the box 41, a wind rotation transmitting part 45, formed to gear with the intermediate gear 18, projects out. The transmitting part 45 is, as shown in FIG. 6, slidably fit on a winder shaft 46. An E-ring 46*a* is fixed to the end of the shaft 46 for the part 45 not to come off the shaft 46.

The winder shaft 46 is fixed on the mounting plate 52, and has a winding worm gear 44 fit on its other end portion. One end of the worm gear 44 is in contact with the plate 52, and the other end is held by an E-ring 44*a* so as not to come off.

A coil spring 47 is provided between the transmitting part 45 and the worm gear 44 with the ends hooked to both elements to urge apart against each other.

When attaching the box 41 to the machine body 1*a*, the transmitting part 45 placed into the gear hole 1*c* slides toward the worm gear 44, being pushed by the top of the intermediate gear 18, then the transmitting part 45 engages with the gear 18, being pushed back by the spring 47. With this engagement, when the winding motor 82 is actuated, the rotation of the gear 18 is transmitted to the transmitting part 45 to cause the worm gear 45 to rotate via the spring 47.

The winding worm gear 44 is in mesh with the gear 55*a* in the second winder part 51. A timing belt 65 is looped about the lower ends of winding gear members 55 in the first and second winder parts 50 and 51. Therefore, rotation of the worm gear 44 rotates both of the gear members 55 and 55. However, the rotation of the gear member 55 is transmitted to the upper mechanism, such as the outer rotating body 57, to wind the thread only in one of the winder parts where the clutch M or N is formed caused by the switching arm holding member 60.

Figure 9:
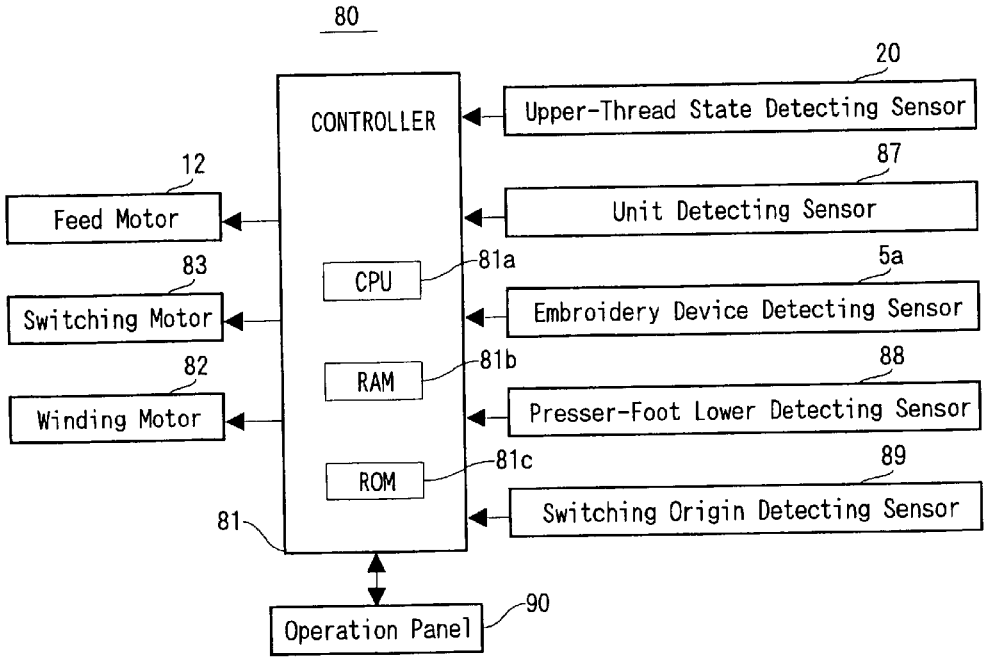
FIG. 9 is a block diagram showing a control circuit of the sewing machine.

FIG. 9 shows a control circuit 80 in the sewing machine 1. The control circuit 80 has a controller 81, which is interfaced with drive sources such as the feed motor 12, the winding motor 82 and the switching motor 83, sensors such as the upper-thread state detecting sensor 20, the embroidery device detecting sensor 5*a*, the unit detecting sensor 87, a presser-foot lower detecting sensor 88, and the switching origin detecting sensor 89, and an operation panel 90. FIG. 9 shows only necessary elements for the invention, but the circuit 80 has other drive sources and sensors.

The controller 81 includes CPU (Central Processing Unit) 81*a*, RAM (Random Access Memory) 81*b*, ROM (Read Only Memory) 81*c*, and I/O interface.

The ROM 81*c* stores control programs and control data for various operations in the machine 1. The RAM 81*b* stores sewing data including stitch data, various detection data, calculated results, etc.

The CPU 81*a* drives various drive sources of motors, controls a series of sewing operations including the thread winding operations and additionally controls display on the operation panel 90, using the RAM 81*b* as working areas, according to the programs and control data stored in the ROM 81*c* based on signals from various sensors.

For example, when the embroidery device 5 is set on the machine 1, the embroidery detecting sensor 5*a* outputs a set signal, which brings the machine 1 into an embroidery mode, and otherwise into a standard mode.

When the winder unit 30 is attached and the unit detecting sensor 87 outputs a unit detecting signal to the CPU, CPU 81*a* performs a thread-winding process according to instructions from the operation panel 90, by driving the feed motor 12, the switching motor 83 and the winding motor 82 while receiving detection signals from the detecting sensor 20. That is, CPU 81*a* is a winding control means in the invention. The CPU 81*a* obtains a thread wound-amount in a winding process with the rotating amount of the winding motor 82 measured by a counter prepared in the RAM 81*b*. This counter is hereinafter referred to as a "wound-amount measuring counter".

During the winding process, the feed motor 12 intermittently feeds the thread, and the winding motor 82 continuously winds the thread, so that the thread repeatedly goes to tensed and loosened states with the repetition of ON and OFF of the detecting sensor 20. The CPU 81*a* controls the winding process by checking the relationship between the ON/OFF of the sensor 20 and the counter value (wound-amount) of the wound-amount measuring counter.

As shown in FIG. 1, the operation panel 90 is provided on the front of the machine body. The panel 90 is composed of a liquid crystal display panel with a touch-panel system, and shows on its display screen necessary information and operation buttons.

As described before, the machine 1 works as a standard mode usually, and goes into an embroidery mode automatically when the embroidery device is set. Attachment of the winder unit 30 allows the machine 1 thread winding operations. Displayed content on the panel 90 changes according to the modes and operations.

Figure 10A:
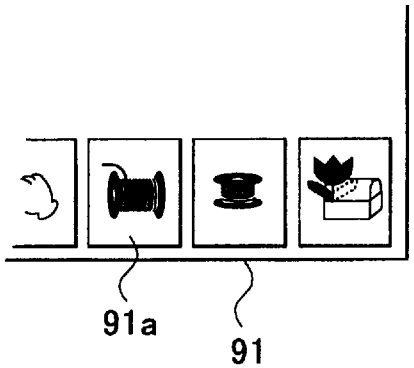
FIGS. 10(*a*) to 10(*c*) show some examples of screens displayed on an operation panel.
Figure 10B:
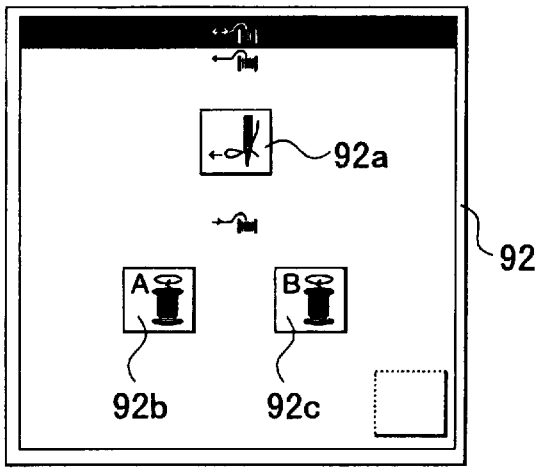
Figure 10C:
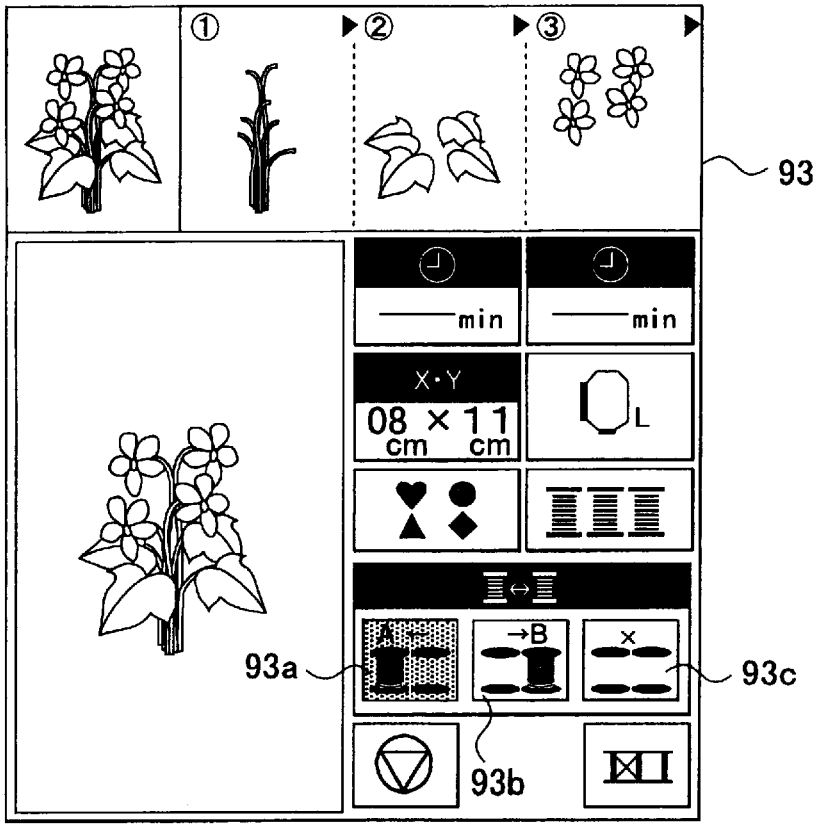

FIGS. 10(*a*) to 10(*c*) shows some picture examples displayed on the panel 90. FIG. 10(*a*) shows a part of a working screen 91 to be used after sewing or the like when the winder unit 30 is installed. There is shown a thread switching button 91*a* at the lower part of the screen 91 for manually instructing the automatic thread winding.

Operation of the switching button 91*a* causes to display a selection screen 92 of FIG. 10(*b*), on which a thread-switching instruction button 92*a*, an A-button 92*b* and a B-button 92*c* are provided. The A-button 92*b* designates the winding on the spool A, and the B-button 92*c* the spool B.

When exchanging the thread, for example, from the thread on the spool A passing through the needle 7 to that on the spool B, the thread on the spool B is hooked on given positions for automatic threading. Then the instruction button 92*a* is operated, and then the A-button 92*b* is touched. These operations allow the winder unit 30 to wind the thread on the spool A, and thereafter the thread from the spool B to be threaded through the needle 7 by the automatic threading mechanism.

Since the feed roller 11 interlocks with the presser foot 6, if the instruction button 92*a* is operated without lowering the presser foot 6, a message "lower a presser foot" will be displayed.

The display screens of FIGS. 10(*a*) and (*b*) are displayed both in the standard mode and the embroidery one.

If the winder unit 30 is installed in the embroidery mode, a reservation function for thread exchange can be selected on an editing screen 93 for various editing operations of an embroidery pattern as shown in FIG. 10(*c*). The editing screen 93 shown as an example relates to a flower pattern, which is formed of the sewing of "(1) stalk", "(2) leaves", and "(3) flowers" sequentially, and can be shown both before and during the sewing.

On the screen 93, there are provided an A-reservation button 93*a*, a B-reservation button 93*b*, and an inhibit-reservation button 93*c*. Let it be assumed, for example, that the first "stalk" is sewn with use of the thread from the spool B together with depression of the A-reservation button 93*a*. Then, after seeing the "stalk", the thread from spool B is automatically wound up, and thereafter the thread from spool A is threaded automatically without such operations as those shown in FIGS. 10(*a*) and (*b*). If the B-button 93*b* is depressed to the contrary, the thread from the spool B will be threaded after automatic winding for the spool A.

If the inhibit-reservation button 93*c* is depressed, automatic winding and threading are not performed after finishing of sewing. In this case, screens of FIGS. 10(*a*) and (*b*) may be displayed after the sewing.

In modes other than the embroidery one, the buttons 93*a*, 93*b* and 93*c* are not displayed. As an alternative, an error can be displayed if the buttons 93*a*, 93*b* or 93*c* are operated with the display of these buttons in modes other than the embroidery one.

Further, if the winder unit 30 is not installed, the operation of the buttons shown in FIGS. 10(*a*) and (*b*) causes to display an error or a message "winder unit 30 is not installed" based on the signal from the detecting sensor 87 regardless of the standard or embroidery modes.

A description will now be given of the operations of a thread winding process with the thread winder unit 30 on the sewing machine 1.

If the automatic thread winding operation is instructed through the A-button 92*b*, the B-button 92*c* or the A-reservation button 93*a* or the B-reservation button 93*b* in FIGS. 10(*a*) and (*b*), the machine 1 mechanically operates under the control of the CPU81*a* as follows. Let it be assumed as a "winding initial state" that: the spools A and B are set in the first and second winder parts 50 and 51, respectively; the thread from the spool A is cut after sewing; the presser foot 6 is lowered, that is, the feed rollor 11 is closed; the thread from the spool A is hooked on the first thread hooking portion 71 and passes through the needle 7; and the thread from the spool B is hooked on the second thread hooking portion 74 and hooked on the given positions for automatic threading.

First, the feed motor 12 is driven to a reverse direction to that in the sewing to pull the thread of the needle 7 side, which is performed intermittently during the winding process.

Then, the winding motor 82 starts to rotate, which causes to rotate the winding gear member 55 in the second winder part 51 through the intermediate gear 18, the transmission part 45, and the worm gear 44. The rotation of the gear member 55 also rotates the gear member 55 in the first winder part 50. The winding motor 82 is continuously driven during the winding.

Next, the switching motor 83 rotates by given angles according to the signal from the switching origin detecting sensor 89, and stops rotating. This rotation causes the switch-actuating pin 64 to move rightward in FIG. 4, which drives the switching pin of the switching arm 61 at the side of the first winder 50 to engage the upper connecting part 57*b* with the lower connecting part 55*b* on the gear member 55 to form the clutch M. With this engagement, the rotation of the winding motor 82 is transmitted for co-rotation of the outer rotating body 57, the inner rotating body 56*c*, the spool walls 56*a* and 56*b*, the bail actuating part 35, and the bail 36. At the same time, the outer body 57 moves downward together with the bail actuating part 36, which turns down the bail 36 to direct the curved portion 36*c* sideway as shown in FIG. 7(*b*). The curved portion 36*c* catches the upper thread and winds it on the spool A.

When the thread end is finally released off between the spool A and the sensor 20, the winding motor 82 and the feed motor 12 stop. The switching motor 83 is driven again to move back to the origin point to finish the winding process. Thereafter, the thread from the spool B is threaded automatically.

In case of winding the thread of the spool B, the switching motor 83 drives the switching pin 62*a*, and the thread is wound at the side of the second winder part 51 in a similar manner as in the first winder part 50.

In the embodiment, the winding motor 82 is driven in advance of rotation of the switching motor 83. This prior rotation makes easier the engagement of the clutch consisting of the lower connecting part 55*b* and the upper connecting part 57*b* than the case that the motor 82 stays still.

Figure 11:
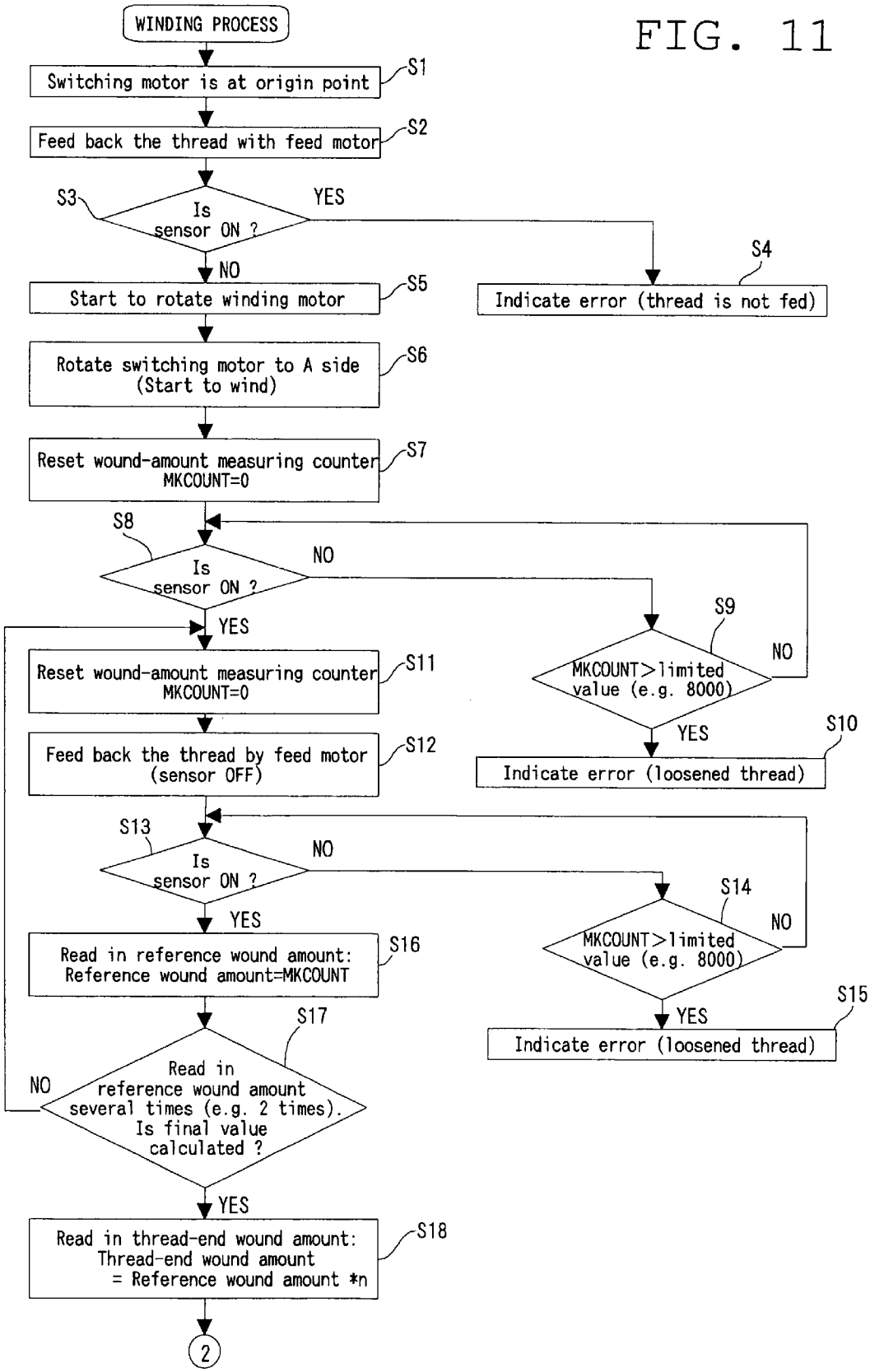
FIG. 11 is a flowchart showing a thread winding process.
Figure 12:
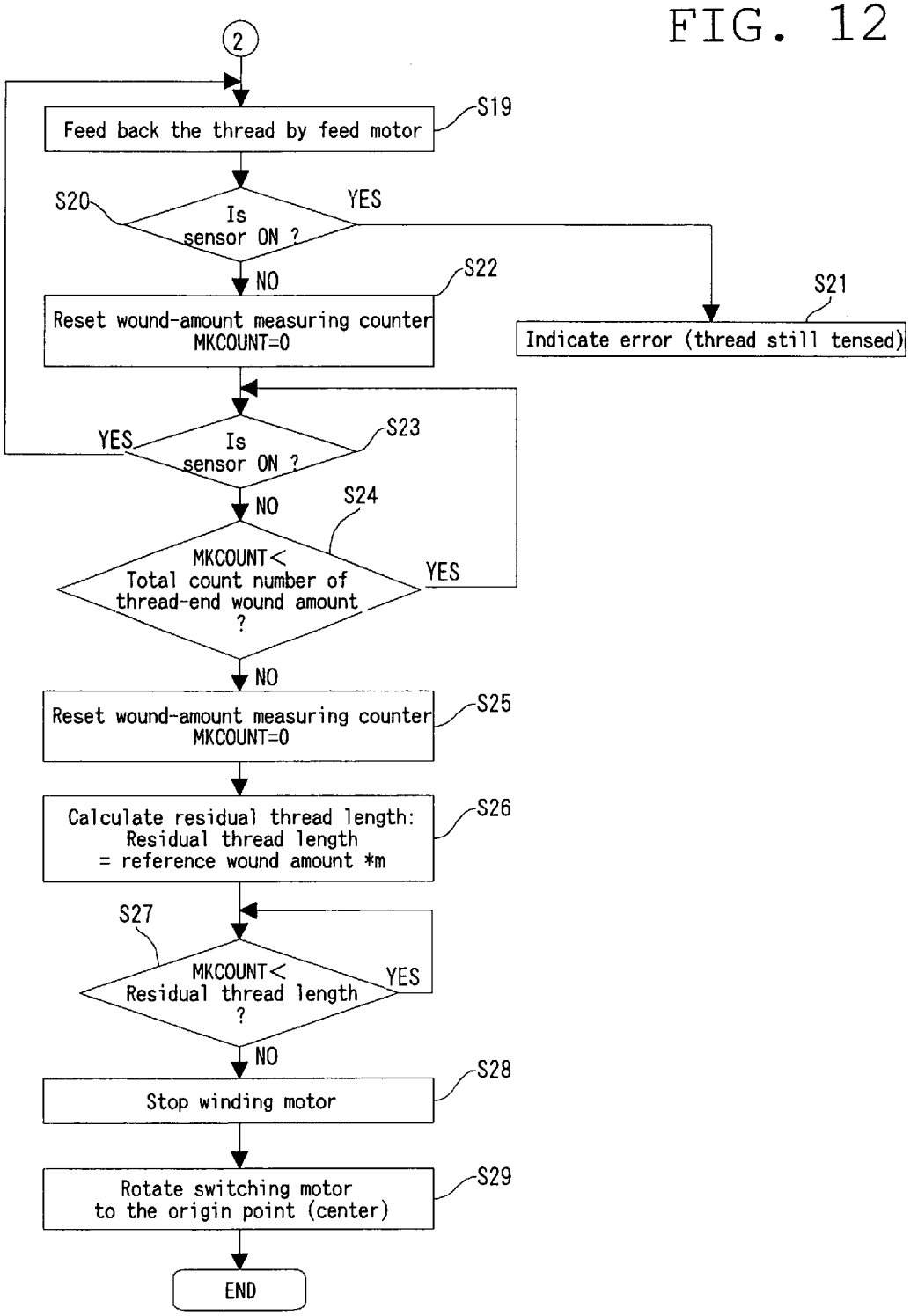
FIG. 12 is a flowchart connecting to the flowchart of FIG. 11.

FIGS. 11 and 12 show a flowchart of the thread winding process performed under the control of the CPU 81*a*.

The CPU 81*a*, based on the signal from the upper thread state detecting sensor 20, monitors whether the winding process is performed correctly, and starts and stops winding, calculating quantitative relationship between the fed amount by the feed motor 12 and the wound amount obtained from the rotating amount of the winding motor 82 or the like. An explanation will be given in case of winding the thread of the spool A.

This flowchart starts from the "winding initial state", where the thread between the spool A and the feed roller 11 is tensed and the sensor 20 outputs ON signal. Initially, at step S1, the switching motor 83 is at the origin position, that is, the switching actuating pin 64 is located at the center. Next at step S2, the feed motor 12 is driven and stops to feed backward the thread by a given amount with the feed roller 11. This causes the thread to be fed in advance to the side of the spool A. This reduces the load on the thread when the bail 36 catches the thread with the motion of turning down sideway due to the actuation of the switching motor 83.

Step S3 checks whether the sensor 20 is still ON, that is, determines whether the sensor 20 goes OFF with the thread fed and loosened at step S2. If yes (continuing ON), the process goes to step S4 to indicate an error, because the thread deems not to be fed due to abnormality such as thread tangling. If no (turned OFF), the process proceeds to step S5 as functioned correctly.

At step S5, the winding motor 82 starts to rotate. At step S6, the switching motor 83 rotates to A side by a given angle, which drives the switching arm 61 for the clutch M to be engaged. This engagement rotates the outer body 57, the spool walls 56*a* and 56*b*, etc., together with the actuation of the bail 36, which starts to wind the thread, guiding the thread on the spool A at its near center in a height direction.

Step S7 resets the wound-amount measuring counter (MKCOUNT) to zero "0", and measures a wound amount based on the rotation of the winding motor 82. Then, step S8 checks whether the sensor 20 turns ON with the thread tensed again during winding that has started at step S6. If no (still OFF), the process proceeds to step S9 which checks whether the MKCOUNT value is over a given limited value (for example 8,000, the number of driven steps of the motor 82). If no (not over), the process moves back to step S8, otherwise (over), the process proceeds with step S10 which indicates an error because the thread deems to be loosened without wound normally.

If the sensor 20 is ON at step S8, the process proceeds to step S11, which resets the MKCOUNT to "0" again and starts to measure the wound amount.

Next, step S12 feeds back the thread by a certain amount with the feed motor 12 driven and stopped, which turns the sensor 20 OFF, because winding speed by the motor 82 is lower than the thread feeding speed by the motor 12.

Step S13 checks whether the thread feeding at step S12 turns the sensor 20 ON. If no (still OFF), the process proceeds to step S14 which checks whether the MKCOUNT value is over a given limited value (for example 8,000). If no (not over), the process moves back to step S13, otherwise (over), the process proceeds with step S15 which indicates an error because the thread deems not to be wound normally due to thread breakage or the like.

If the sensor 20 is ON at step S13, the process proceeds to step S16, which reads in as a "reference wound amount" the wound amount that has started to be measured at step S11.

At step S17, reference wound amounts at step S16 are read in several times and determines if the final value is calculated. If read in at step S16 onlyy one time, the process moves back to step S11, and if read in several times (for example, two times), the final wound value is obtained. The value may be a mean value, or an experimental optimum value. Thus, the firstly measured value is abandoned and reference wound value (wound value per one feeding) ar etaken several times, because the initial wound value differs from the value in a stable state, and the value changes a little every time. Several times of measurements excluding the first time data allow figuring out a more precise value.

Subsequently, at step S18, a "thread-end wound amount" is calculated and read in as a wound value to be used hereafter. This value equals n times the reference wound value obtained at step S17, where n is determined depending on the structure of the machine 1, for example "6". The thread-end wound amount is determined to be a thread length to be wound at later steps, the length being excluded a last winding amount (residual thread length).

Next, at step S19 in FIG. 12, the feed motor 12 feeds the thread backward, and the process proceeds to step S20 to check whether the sensor 20 is ON. If yes (still ON), the process proceeds with step S21 to indicate an error, because the thread may abnormally hang somewhere to be tensed.

If the sensor 20 is OFF at step S20, the process proceeds to step S22, which resets the measurement counter or MKCOUNK=0. Step S23 checks whether the sensor 20 turns ON with the thread wound. If no (still OFF), the process moves to step S24 to check whether MKCOUNT value is less than the total count number corresponding to the thread-end wound amount obtained at step S18. If yes (smaller), the process moves back to step S23, otherwise (larger), determining that the thread has been wound by the thread-end wound amount, the process proceeds to step S25.

If the sensor 20 is ON at step S23, the process loops back to step S19. That is, step S19 to step S24 are repeated until the thread is wound more than the thread-end wound amount.

At step S25, MKCOUNT value is reset again to "0", and step S26 calculates the residual thread length. The residual thread length equals "reference wound amount" multiplied by m, where m is determined depending on the machine structure. Next, step S27 checks whether MKCOUNT value is less than the residual thread length. If yes (less), step S27 is repeatedly performed. When the MKCOUNT becomes over the residual thread length, the process proceeds to step S28 which stops the winding motor 82 to finish winding with the thread-end remaining between the sensor 20 and the spool A.

Then, at step S29, the switching motor 83 is driven by given angles to move back the switch actuating pin 64 to the origin point, and the process ends.

The thread winding method in the machine 1 equipped with the thread winder unit 30 has various advantages. The automatic thread winding is performed under the control of CPU 81*a* using the feed means consisting of the feed roller 11 and the feed motor 12, thereby improving efficiency in the winding process and resulting in easier exchange of thread spools. A conventionally used thread feed means is employed for thread winding, so that the thread winding mechanism can be realized relatively easily in lower cost.

The CPU 81*a* calculates the reference wound amount, using the thread length wound by the winder unit 30 every time the feed means feeds the thread, to thereby control the thread wound amount quantitatively and consistently.

The winder unit 30 is removably attached to the machine body 1*a*, and therefore can be attached according to necessity, resulting in higher convenience.

Further, the winder unit 30 has two spool bars 31 and 32, which allows the thread to be wound on either side of the spools by the switching arm holding member 60. Therefore, during sewing with the thread from one spool, the other side spool can be mounted, so that the latter thread is ready for sewing when the former thread is automatically wound up after the previous sewing. This is especially useful if frequent exchange of thread is needed as in embroidery sewing.

In addition, the winding motor 82 and the switching motor 83 are equipped inside the machine body 1*a* so that these motors can couple to the components at the side of the winder unit 30 when the unit is attached to the machine body 1*a*. This structure allows the unit 30 to be simplified because the winding and switching drive sources are not incorporated within the unit 30.

The invention is not limited to the embodiments described above, and various variations and modifications may be made. For instance, a home-use embroidery sewing machine is embodied as one example, but the invention can be applied to industrial sewing machines, or sewing machines without an embroidery device. That is, the invention is applicable to all kinds of sewing machines each of which sews a work material with plural kinds of thread. The "plural kinds of thread" means not only plural colors of thread but also different characteristics of thread.

The number of spool bars is not critical, and may be three or more instead of two.

As for an exchange mechanism for exchanging the spool to wind the thread, other modifications can be employed instead of the combination of a motor inside the machine body and a switching arm in a unit.

Further, it has been described that a motor for winding thread is provided inside the machine body of a sewing machine; however, such a motor may be provided in a thread winder unit.

What is claimed is:

1. A thread device for a sewing machine, comprising:

a spool mounting member which rotatably supports a thread spool wound with thread to be fed to a needle of the sewing machine and is attached to a machine body of the sewing machine;

a thread winding mechanism which is connected to the thread spool and feeds backward the thread, being fed from the thread spool to a needle side, to the thread spool;

a feed mechanism which is disposed on a thread path between the thread winding mechanism and the needle of the sewing machine and performs an operation feeding the thread of the thread spool to the needle side and an operation feeding the thread in the needle side to a side of the thread winding mechanism;

a thread detecting mechanism which is disposed between the feed mechanism and the thread winding mechanism and generates a first detecting signal when detecting the thread in a tense state;

a feed-backward amount detecting mechanism which generates a second detecting signal when an amount of the thread fed backward to the thread spool by the thread winding mechanism reaches a given value; and a controller which feeds a given amount of the thread to the side of the thread winding mechanism by operating the feed mechanism when the first detecting signal is generated by the thread detecting mechanism, repeats a feed-backward operation in which the given amount of the thread is fed backward by the thread winding mechanism after feeding the given amount of the thread, and stops winding when the second detecting signal is generated by the feed-backward amount detecting mechanism.

2. The thread device according to claim 1, wherein the controller obtains a reference wound amount from an amount wound by the thread winding mechanism and uses the reference wound amount as a reference value for a wound amount in a following process.

3. The thread device according to claim 1, wherein the thread winding mechanism includes:

a motor which rotates the thread spool in a feed-backward direction; and a transmitting mechanism which transmits drive of the motor to the thread spool.

4. The thread device according to claim 3, wherein the motor is attached to the machine body of the sewing machine, and wherein the transmitting mechanism is attached to the spool mounting member and includes:

a coupling member which is couplable and uncouplable with respect to a drive shaft of the motor; and a coupling mechanism which couples the coupling member to the thread spool.

5. A thread device for a sewing machine, comprising:

spool mounting members each of which rotatably supports a thread spool wound with thread different from the other thread to be fed to a needle of the sewing machine and is attached to a machine body of the sewing machine;

a motor which rotates the thread spool in a feed-backward direction; and a transmitting mechanism which transmits drive of the motor to the thread spool; and a switching mechanism which selectively couples one of the thread spools to the transmitting mechanism.

6. The thread device according to claim 5, wherein the switching mechanism includes:

a switching drive source which electrically operates and is attached to the machine body of the sewing machine; and a lever which is attached to the spool mounting member and couples the transmitting mechanism to one of the thread spools by an operation of the switching drive source.

* * * * *